US008052460B1

(12) United States Patent
Tang et al.

(10) Patent No.: US 8,052,460 B1
(45) Date of Patent: Nov. 8, 2011

(54) ELECTRICAL CONNECTOR ASSEMBLY AND ADJUSTABLE RECEIVING CONNECTOR THEREOF

(75) Inventors: Xian-Xiu Tang, Shenzhen (CN); Zhen-Xing Ye, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 12/877,999

(22) Filed: Sep. 8, 2010

(30) Foreign Application Priority Data

Jul. 5, 2010 (CN) ..... 2010 1 0217574.6

(51) Int. Cl.
*H01R 13/64* (2006.01)

(52) U.S. Cl. ..... 439/374; 439/681

(58) Field of Classification Search ..... 439/374, 439/217, 680, 681
See application file for complete search history.

(56) References Cited

U.S. PATENT DOCUMENTS

| | | | | |
|---|---|---|---|---|
| 5,697,805 | A * | 12/1997 | Orstad et al. | 439/374 |
| 5,785,536 | A * | 7/1998 | McCartin et al. | 439/78 |
| 6,500,018 | B1 * | 12/2002 | Pfaffenberger et al. | 439/325 |
| 6,932,637 | B2 * | 8/2005 | Ewers et al. | 439/248 |
| 2006/0240715 | A1 * | 10/2006 | Zueck et al. | 439/681 |

* cited by examiner

*Primary Examiner* — Hien Vu
(74) *Attorney, Agent, or Firm* — Altis Law Group, Inc.

(57) ABSTRACT

An electrical connector assembly includes a receiving connector and an insert connector. The receiving connector includes a main body and a locating plate movably attached to the main body. The main body is provided with a first flange. The locating plate is provided with a second flange formed thereon. The first flange and the second flange are spaced from each other. The insert connector includes a base and a fixing plate formed on the base. The fixing plate has a particular width and is positioned between the first flange and the second flange. The locating plate is slidable on the main body between different positions to regulate a gap defined between the first flange and the second flange, to cause the receiving connector to be able to match with the insert connector having the fixing plate of the particular width or other width.

18 Claims, 7 Drawing Sheets

ELECTRICAL CONNECTOR ASSEMBLY AND ADJUSTABLE RECEIVING CONNECTOR THEREOF

BACKGROUND

1. Technical Field

The present disclosure relates to an electrical connector assembly, and particularly to an electrical connector assembly achieving electrical connection by way of a receiving connector and an insert connector.

2. Description of Related Art

Electrical connector assemblies are commonly used for electrically connecting an electronic component to a drive circuit of an electronic device, such as a computer. Generally, an electrical connector assembly includes a receiving connector electrically connected to the electronic component with a plurality of cables, and an insert connector electrically connected with the drive circuit.

The receiving connector includes a main body which defines a plurality of receiving holes therein A plurality of conductors are received in the receiving holes, respectively, and are electrically connected with the cables. The insert connector includes a base and a plurality of pins protruding upwardly from the base corresponding to the receiving holes of the receiving connector. The pins are electrically connected with a plurality of electrodes of the drive circuit, respectively. In assembly, the receiving connector is assembled on the insert connector, and the pins of the insert connector are respectively inserted into the receiving holes of the receiving connector and electrically contact the conductors in the receiving holes to achieve electrical connection between the electronic component and the drive circuit.

However, different electronic components usually require different drive voltages or different drive modes. Thus, different electrical connector assemblies with different receiving connectors and insert connectors are needed to accommodate these requirements. The cost of providing various electrical connector assemblies may be high.

Accordingly, what is needed is a means which can overcome the limitations described.

DETAILED DESCRIPTION

Figure 1:
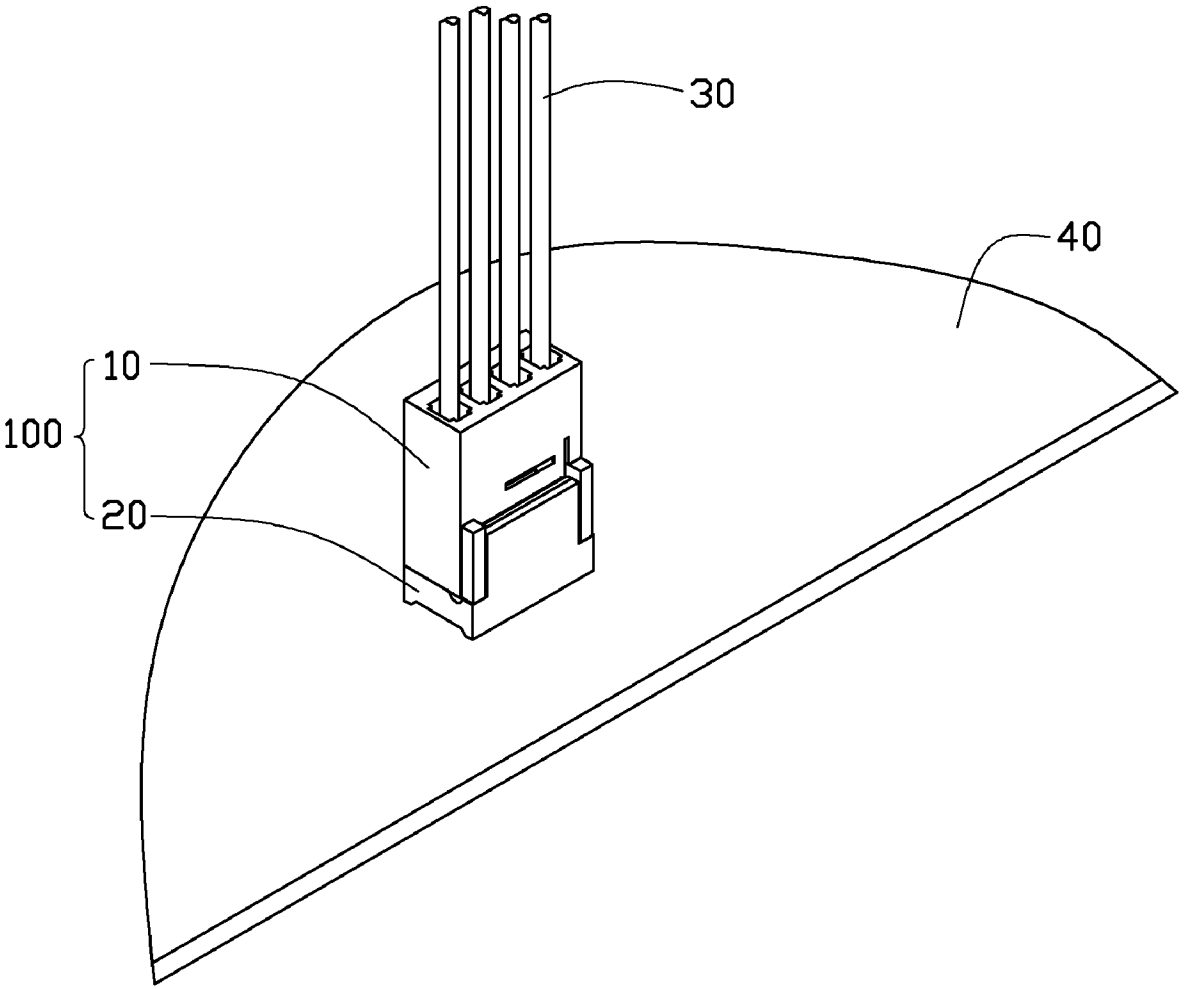
FIG. 1 is an isometric, assembled view of an electrical connector assembly in accordance with a first embodiment.

Referring to FIG. 1, an electrical connector assembly 100 according to a first embodiment is shown. The electrical connector assembly 100 includes a receiving connector 10 and an insert connector 20. In this embodiment, the receiving connector 10 is a kind of female connector, in the form of a receptacle, socket or jack. The insert connector 20 is a kind of male connector, in the form of a plug. The receiving connector 10 is electrically connected with an electronic component (not shown) by four cables 30, and the insert connector 20 is mounted on a circuit board 40 and electrically connected with a drive circuit (not shown) on the circuit board 40. When the receiving connector 10 is connected with the insert connector 20, the electronic component is electrically connected to the drive circuit of the circuit board 40, so that the circuit board 40 can provide an electrical current to the electronic component.

Figure 2:
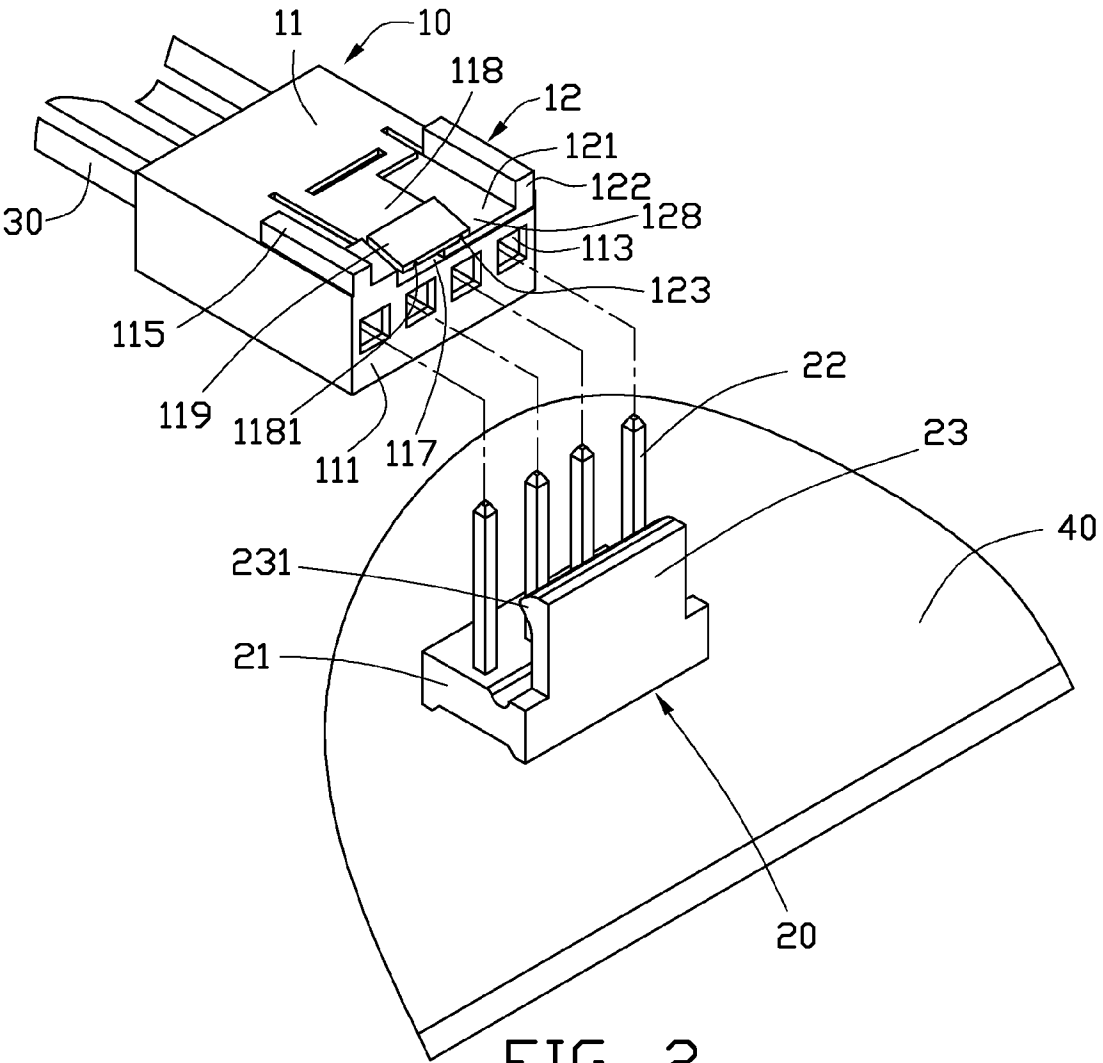
FIG. 2 is an isometric, exploded view of the electrical connector assembly of FIG. 1.
Figure 3:
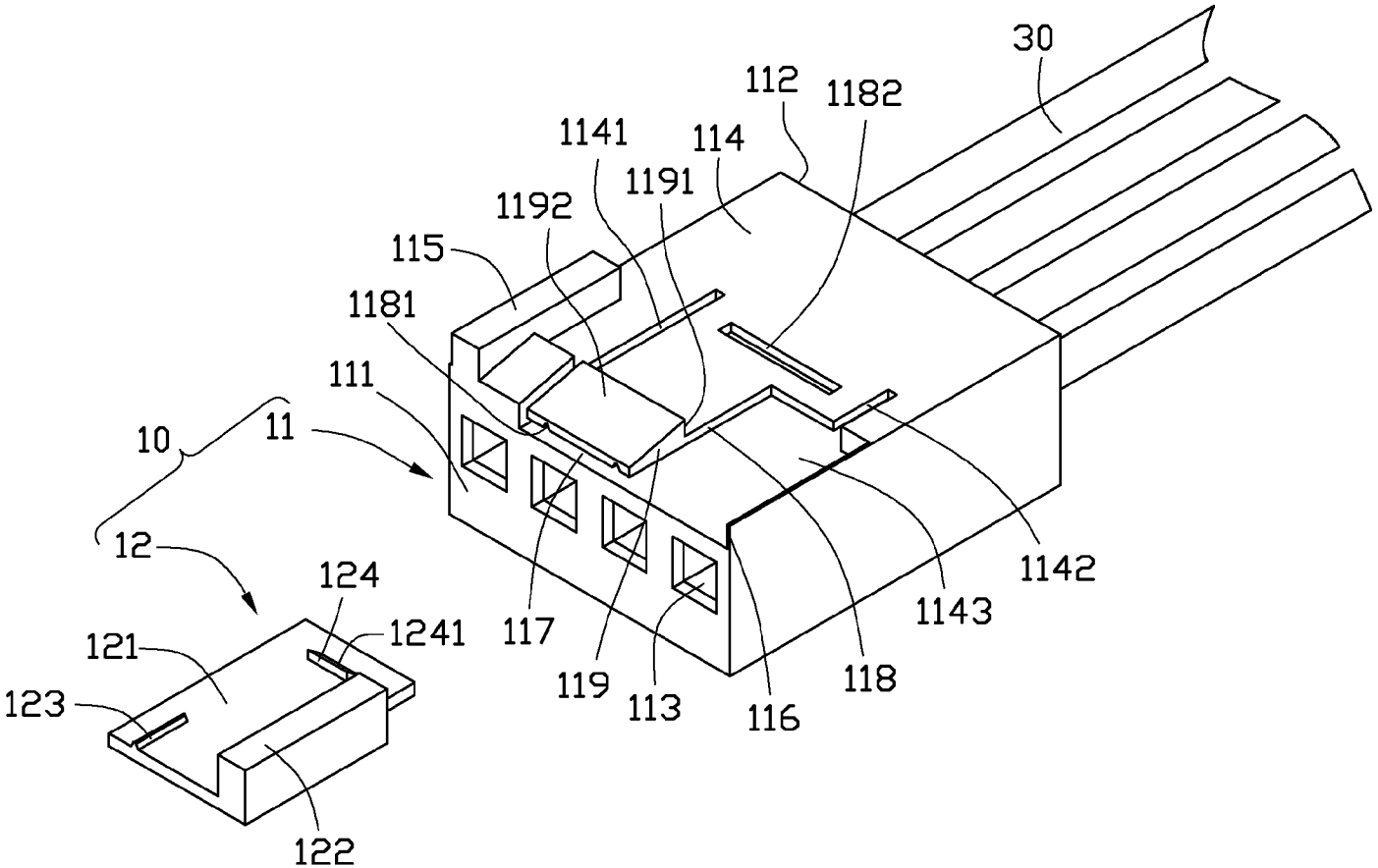
FIG. 3 is an isometric, exploded view of a receiving connector of the electrical connector assembly of FIG. 1.

Referring to FIGS. 2 and 3, the receiving connector 10 includes a main body 11 and a locating plate 12 movably attached to the main body 11. The locating plate 12 can be attached at different positions on the main body 11 and slid between the different positions.

The main body 11 includes an insert end 111 and an opposite connecting end 112. The main body 11 defines four receiving holes 113 therein. The four receiving holes 113 are parallel to each other and run through both the insert end 111 and the connecting end 112. The four cables 30 are respectively inserted into the four receiving holes 113 through the connecting end 112. The main body 11 has a side surface 114. A first flange 115 protrudes outwardly from a first lateral side of the side surface 114 near the insert end 111. The first flange 115 is elongated and parallel to an extension direction of each receiving hole 113.

The main body 11 defines a clearance 117 at the insert end 111. The clearance 117 has a low-profile dimension, and is located at a level below the side surface 114. The clearance 117 extends from the insert end 111 towards a middle portion of the main body 11. A tongue plate 118 is formed on the main body 11 above the clearance 117, and at a level generally corresponding to the side surface 114. The clearance 117 is parallel to the side surface 114. A first groove 1141 is defined in the side surface 114 near the first flange 115. The first groove 1141 is elongated and parallel to the first flange 115. The first groove 1141 communicates with the clearance 117, and runs through the insert end 111. A second groove 1142 is defined in the side surface 114 near a second lateral side of the side surface 114. The second groove 1142 communicates with the clearance 117 and is parallel to the first groove 1141, with the tongue plate 118 located between the first groove 1141 and the second groove 1142. The tongue plate 118 has an inner end extending from the main body 11, and a free outer end at the insert end 111 of the main body 11.

A cutout 1143 is defined in the side surface 114 adjacent to the second lateral side of the side surface 114. The cutout 1143 is wider than the second groove 1142 and runs through the insert end 111 of the main body 11. A restricting flange 116 is formed at the second lateral side of the side surface 114. The cutout 1143 is located between a right side of the tongue plate 118 and the restricting flange 116.

An inner surface of the tongue plate 118, which faces the clearance 117, defines two elongated locating notches 1181 therein. The two locating notches 1181 are spaced apart from each other, and parallel to the extension direction of each receiving hole 113. The two locating notches 1181 are located adjacent to the left side and the right side of the tongue plate 118, respectively. Each of the locating notches 1181 defines a triangular cross section. An elongated sliding slot 1182 is defined in the fixed inner end of the tongue plate 118 between the first groove 1141 and the second groove 1142. The sliding slot 1182 is perpendicular to the first flange 1141, and communicates with the clearance 117. A wedge-shaped hook 119 protrudes outwardly from the free outer end of the tongue plate 118. The hook 119 is provided with a hooking step 1191 and a guiding surface 1192. The hooking step 1191 faces the connecting end 112 of the main body 11, and is perpendicular to the tongue plate 118. The guiding surface 1192 extends down at an angle from the top of the hooking step 1191 to the free outer end of the tongue plate 118.

The locating plate 12 is substantially L-shaped. The locating plate 12 includes a sliding plate 121, and a second flange 122 protruding outwardly from a right lateral side of the sliding plate 121. A locating bar 123 protrudes up near a lateral left side of the sliding plate 121. The locating bar 123 is elongated and parallel to the second flange 122. A cross section of the locating bar 123 is the same as that of each locating notch 1181 of the tongue plate 118, i.e., triangular. A sliding bar 124 protrudes up from another side of the sliding plate 121. The sliding bar 124 is elongated, and perpendicular to the second flange 122. A sliding surface 1241 is formed on the sliding bar 124. The sliding surface 1241 is obliquely oriented, and faces towards an outside of the locating plate 12.

When the locating plate 12 is assembled to the main body 11, in one example, the sliding plate 121 of the locating plate 12 is oriented to render the sliding surface 1241 of the sliding bar 124 facing generally towards the insert end 111 of the main body 11. Then the sliding plate 121 is inserted into the clearance 117 of the main body 11 with the locating bar 123 of the locating plate 12 aligned with the right side one of the locating notches 1181 of the tongue plate 118. The second flange 122 is aligned with the cutout 1143. The locating plate 12 is pushed towards the tongue plate 118 and under the clearance 117 of the main body 11. The tongue plate 118 is flexed resiliently by the sliding surface 1241 of the sliding bar 124 until the sliding bar 124 slides into the sliding slot 1182. In this state, the locating bar 123 is received in the right side locating notch 1181; and the second flange 122 of the locating plate 12 is received in the cutout 1143, and abuts the restricting flange 116 (see FIG. 2).

The insert connector 20 includes a rectangular base 21 mounted on the circuit board 40, four pins 22 extending through and out of the base 21, and a fixing plate 23 extending up from a lateral side of the base 21. The base 21 is made of electrically insulating material, while the pins 22 are made of material with good electrical conductivity, such as metal. Bottom ends of the pins 22 are embedded in the base 21 and electrically connected with the drive circuit of the circuit board 40. The four pins 22 are juxtaposed and parallel to each other. The fixing plate 23 is parallel to and faces the pins 22. The fixing plate 23 is provided with a hooking block 231 formed at a top thereof. The hooking block 231 protrudes from the top of the fixing plate 23 towards the pins 22.

The sliding bar 124 of the locating plate 12 can slide in the sliding slot 1182 of the tongue plate 118. When the sliding bar 124 is located at one end of its path of travel, the locating bar 123 of the locating plate 12 is engaged in one of the two locating notches 1181; and when the sliding bar 124 is located at an opposite end of its path of travel, the locating bar 123 of the locating plate 12 is engaged in the other locating notch 1181. In this embodiment, the locating bar 123 is firstly received in the right side locating notch 1181 (the one nearer the restricting flange 116 of the main body 11) to define a gap 128 between the first flange 115 and the second flange 122. A width of the gap 128 is substantially equal to a width of the fixing plate 23.

When the second flange 122 is manipulated by a user so as to slide the locating plate 12 in a transverse direction in the clearance 117 of the main body 11, the sliding bar 124 slides in the sliding slot 1182 of the tongue plate 118, and the locating bar 123 is disengaged from the right side locating notch 1181. The tongue plate 118 is forced by the locating bar 123 to flex resiliently until the locating bar 123 slides into the left side locating notch 1181 (the one nearer the first flange 115 of the main body 11).

During assembly of the receiving connector 10 and the insert connector 20, the insert end 111 of the main body 11 is oriented to face the insert connector 20, with the receiving holes 113 respectively aligned with the pins 22 of the insert connector 20, and the fixing plate 23 aligned with the gap 128 between the first flange 115 of the main body 11 and the second flange 122 of the locating plate 12. The receiving connector 10 is pushed towards the insert connector 20 to cause the pins 22 of the insert connector 20 to respectively insert into the receiving holes 113 of the receiving connector 10. The hooking block 231 of the fixing plate 23 slides along the guiding surface 1192 of the hook 119 of the tongue plate 118 until the hooking block 231 has passed over the hook 119 and hooks on the hooking step 1191 of the hook 119 of the tongue plate 118. Thereby, the receiving connector 10 is mounted on the insert connector 20. Since the gap 128 between the first flange 115 and the second flange 122 is substantially equal to the width of the fixing plate 23, the fixing plate 23 is fittingly sandwiched between the first flange 115 and the second flange 122.

In the present disclosure, the locating plate 12 can be located at different positions in the clearance 117 of the main body 11. Thus, the gap 128 between the first flange 115 of the main body 11 and the second flange 122 of the locating plate 12 is adjustable, which enables the receiving connector 10 to be able to match with different insert connectors 20 with different fixing plates 23 having different widths. Other exemplary embodiments will be described below to help understand the scope and spirit of the present disclosure.

Figure 4:
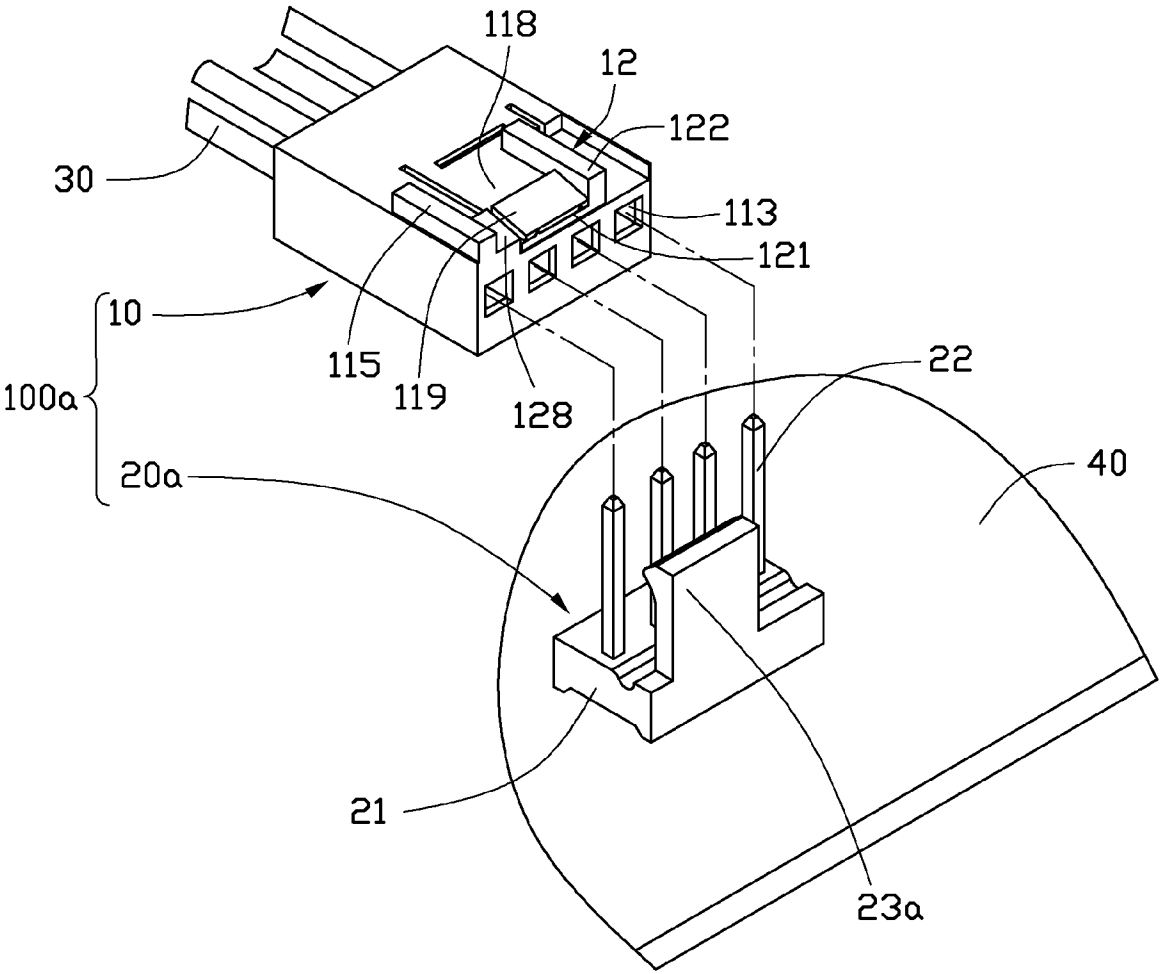
FIG. 4 is an isometric, exploded view of an electrical connector assembly in accordance with a second embodiment.
Figure 5:
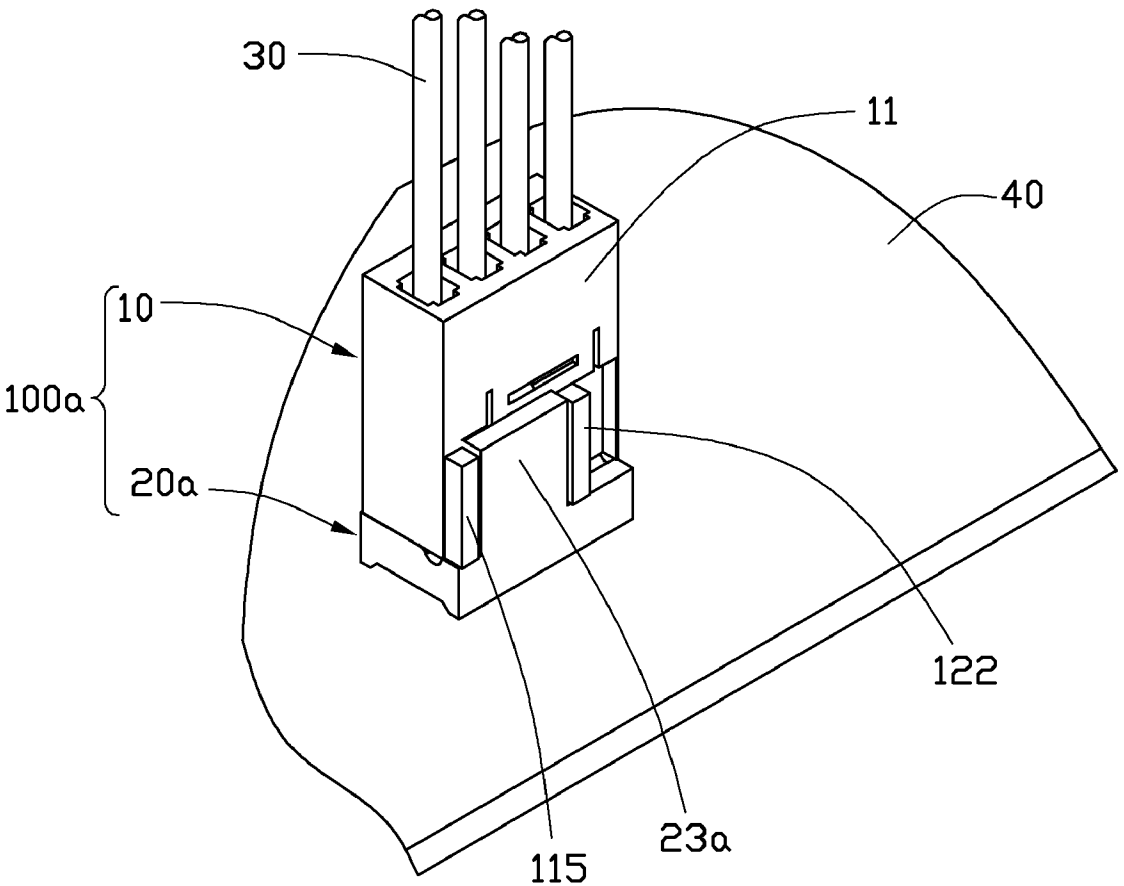
FIG. 5 is an assembled view of the electrical connector assembly of FIG. 4.

FIGS. 4 and 5 show an electrical connector assembly 100*a* according to a second embodiment. The electrical connector assembly 100*a* differs from the electrical connector assembly 100 of the first embodiment only in that the fixing plate 23*a* of the insert connector 20*a* faces only three adjacent pins 22 of the insert connector 20*a*. The insert connector 20*a* with only the three adjacent pins 22 facing the fixing plate 23*a* thus differentiates from the insert connector 20 of the first embodiment. That is, the fixing plate 23*a* has a width smaller than that of the fixing plate 23 of the first embodiment.

Before assembly of the electrical connector assembly 100*a*, the locating plate 12 is adjusted to cause the locating bar 123 thereof to slide into the left side locating notch 1181 (the one nearer the first flange 115). This makes the gap 128 between the first flange 115 and the second flange 122 substantially equal to a width of the fixing plate 23*a*. Then, the receiving connector 10 is assembled to the insert connector 20*a* in substantially the same manner as described above in relation to the first embodiment.

In the above disclosures, the locating plate 12 of the receiving connector 10 is slideable to be located at different positions on the main body 11 of the receiving connector 10, to match with the insert connectors 20, 20*a* as needed. Thus, the receiving connector 10 can be firmly assembled to the desired insert connector 20 or 20*a*. Furthermore, when the locating bar 123 is retained in the left side locating notch 1181 (the one nearer the first flange 115), the receiving connector 10 can only be engaged with the insert connector 20*a*, and cannot be engaged with the insert connector 20. Thus, when the locating bar 123 is in such position, mismatching of the receiving connector 10 with the insert connector 20 is prevented.

Figure 6:
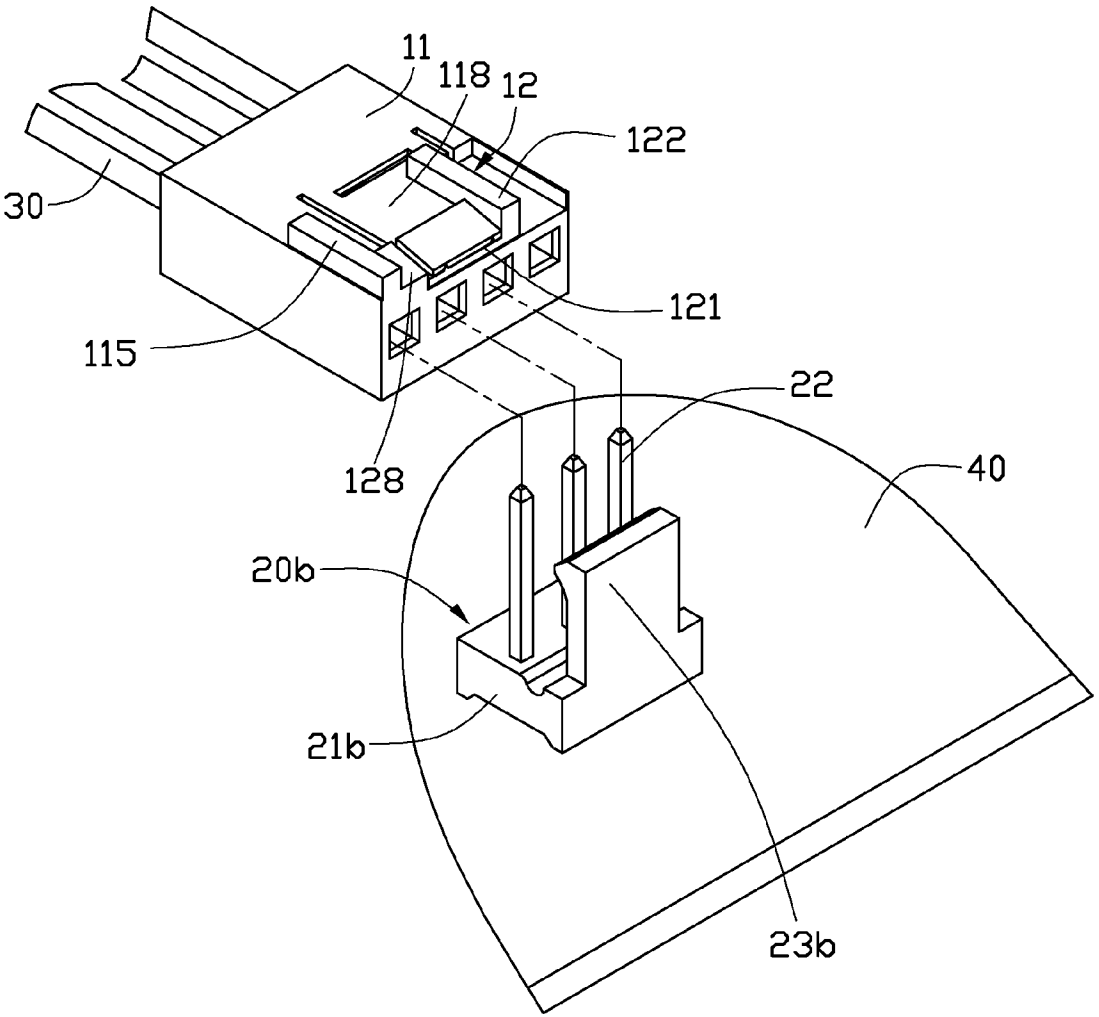
FIG. 6 is an isometric, exploded view of an electrical connector assembly in accordance with a third embodiment.
Figure 7:
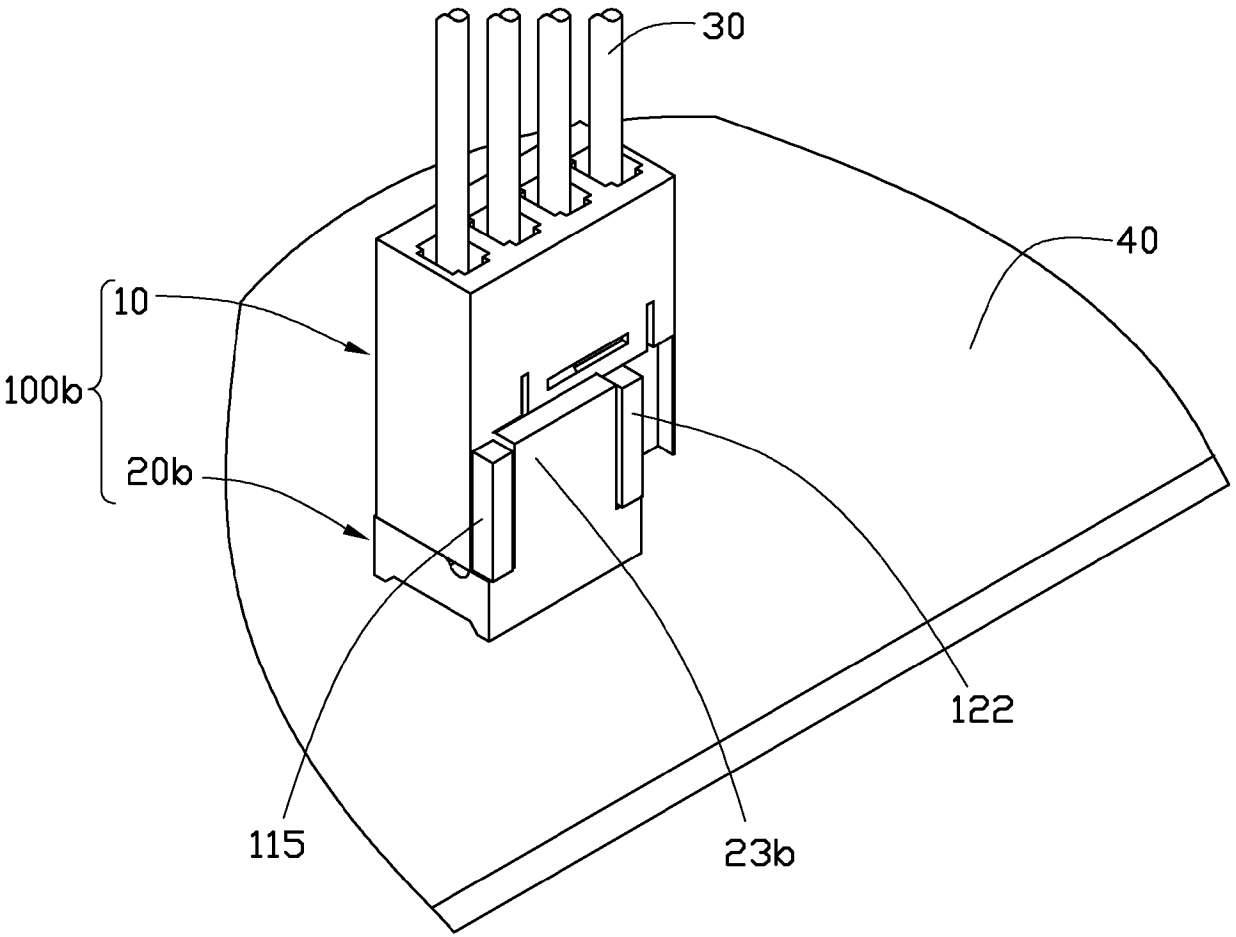
FIG. 7 is an assembled view of the electrical connector assembly of FIG. 6.

FIGS. 6 and 7 show an electrical connector assembly 100*b* according to a third embodiment. The electrical connector assembly 100*b* differs from the electrical connector assemblies 100, 100*a* of the above embodiments only in that the insert connector 20*b* includes a rectangular base 21*b*, three pins 22 extending through and out of the base 21*b*, and a fixing plate 23*b* extending up from a lateral side of the base 21*b*. The fixing plate 23*b* faces the three pins 22. The fixing plate 23*b* has a width the same as that of the fixing plate 23*a* of the second embodiment.

Before the electrical connector assembly 100*b* is assembled, the locating plate 12 is adjusted to position the locating bar 123 in the left side locating notch 1182 (the one nearer the first flange 115) to make the gap 128 between the first flange 115 and the second flange 122 substantially equal to a width of the fixing plate 23*b*. Then, the receiving connector 10 is assembled to the insert connector 20*b* in much the same manner as described above in relation to the first embodiment.

Although the number of pins 22 of the insert connector 20*b* is less than that of the receiving holes 113 of the receiving connector 10, the receiving connector 10 can still be connected with the insert connector 20*b* by adjusting the position of locating plate 12 of the receiving connector 10. Thereby, the receiving connector 10 has multi-functional adaptabilities.

It is to be understood, however, that even though numerous characteristics and advantages of the exemplary embodiments have been set forth in the foregoing description, together with details of the structures and functions of the embodiments, the disclosure is illustrative only, and that changes may be made in detail, especially in matters of shape, size, and arrangement of parts within the principles of the embodiments to the full extent indicated by the broad general meaning of the terms in which the appended claims are expressed.

What is claimed is:

1. An electrical receiving connector for connecting with any selected one of a plurality of different insert connectors to achieve electrical connection between the receiving connector and the selected insert connector, the receiving connector comprising:

a main body provided with a first flange; and a locating plate movably attached to the main body, the locating plate provided with a second flange, the first flange and the second flange being spaced apart from each other with a gap defined therebetween;

wherein the locating plate is slidable on the main body between different positions to regulate the gap between the first flange and the second flange, whereby the receiving connector is able to match with any selected one of the plurality of different insert connectors wherein the first flange extends outwardly from a side surface of the main body, the main body comprises a connecting end and an insert end, the main body defines a clearance at the insert end with a tongue plate formed on the main body above the clearance, the tongue plate is located at a level corresponding to a level of the side surface, and the locating plate is slidably received in the clearance.

2. The receiving connector of claim 1, wherein the locating plate further comprises a sliding plate, the second flange is formed on a lateral side of the sliding plate, and the sliding plate is slideably received in the clearance.

3. The receiving connector of claim 2, wherein a first groove and a second groove are respectively defined in the side surface, and the first groove and the second groove both communicate with the clearance and run through the insert end.

4. The receiving connector of claim 2, wherein an inner surface of the tongue plate, which faces the clearance, defines a plurality of locating notches therein, the locating notches are spaced from each other, a locating bar protrudes up from the sliding plate of the locating plate, and the locating bar is received in a selected one of the locating notches to assemble the locating plate at a desired position on the main body.

5. The receiving connector of claim 4, wherein each of the locating notches defines a triangular cross section, and the locating bar also has a triangular cross section.

6. The receiving connector of claim 2, wherein the tongue plate defines a sliding slot therein, a sliding bar protrudes up from the sliding plate, and when the sliding plate slides in the clearance, the sliding bar slides along the sliding slot.

7. The receiving connector of claim 2, wherein a wedge-shaped hook protrudes outwardly from the tongue plate, the hook is provided with a hooking step and a guiding surface, and the guiding surface extends at an angle from a top of the hooking step to an end of the hook at the insert end of the main body.

8. The receiving connector of claim 2, wherein the first flange is formed at a first lateral side of the side surface of the main body, a cutout is defined in the side surface adjacent to a second lateral side of the side surface opposite to the first lateral side, the cutout runs through the insert end of the main body, and when the locating plate slides in the clearance of the main body, the second flange moves in the cutout.

9. The receiving connector of claim 8, wherein a restricting flange is formed on the second lateral side of the side surface, and the locating plate is located between the first flange and the restricting flange.

10. An electrical connector assembly comprising:

a receiving connector comprising a main body and a locating plate movably attached to the main body, the main body being provided with a first flange, the locating plate being provided with a second flange, the first flange and the second flange being spaced apart from each other with a gap defined therebetween, a plurality of receiving holes being defined in the main body; and an insert connector comprising a base, a plurality of pins extending from the base, and a fixing plate formed on the base, the pins being respectively inserted in the receiving holes, the fixing plate having a particular width and being received in the gap and sandwiched between the first flange and the second flange;

wherein the locating plate is slidable on the main body between different positions to regulate the gap defined between the first flange and the second flange, whereby the receiving connector is able to match with the insert connector having the fixing plate of the particular width, and is also able to match with at least one other insert connector comprising a fixing plate of a particular width different from the particular width of the insert connector;

wherein the first flange extends outwardly from a side surface of the main body, the main body comprises a connecting end and an insert end, the main body defines a clearance in the insert end with a tongue plate formed on the main body above the clearance, the tongue plate is located at a level corresponding to a level of the side surface, and the locating plate is slidably received in the clearance.

11. The electrical connector assembly of claim 10, wherein the locating plate further comprises a sliding plate, the second flange is formed on a lateral side of the sliding plate, and the sliding plate is slideably received in the clearance.

12. The electrical connector assembly of claim 11, wherein a first groove and a second groove are defined in the side surface, and the first groove and the second groove both communicate with the clearance and run through the insert end.

13. The electrical connector assembly of claim 11, wherein an inner surface of the tongue plate, which faces the clearance, defines a plurality of locating notches therein, the locating notches are spaced from each other, a locating bar protrudes up from the sliding plate of the locating plate, and the locating bar is received in a selected one of the locating notches to assemble the locating plate at a desired position on the main body.

14. The electrical connector assembly of claim 13, wherein each of locating notches defines a triangular cross section, and the locating bar also has a triangular cross section.

15. The electrical connector assembly of claim 11, wherein the tongue plate defines a sliding slot therein, a sliding bar protrudes outwardly from the sliding plate, and when the sliding plate slides in the clearance, the sliding bar slides along the sliding slot.

16. The electrical connector assembly of claim 11, wherein a wedge-shaped hook protrudes outwardly from the tongue plate, the hook is provided with a hooking step and a guiding surface, and the guiding surface extends at an angle from a top of the hooking step to an end of the hook at the insert end of the main body.

17. The electrical connector assembly of claim 11, wherein the first flange is formed at a first lateral side of the side surface of the main body, a cutout is defined in the side surface adjacent to a second lateral side of the side surface opposite to the first lateral side, the cutout runs through the insert end of the main body, and when the locating plate slides in the clearance of the main body, the second flange moves in the cutout.

18. The electrical connector assembly of claim 10, wherein the number of the receiving holes is more than that of the pins.

* * * * *